United States Patent [19]

Essig

[11] Patent Number: 4,548,057

[45] Date of Patent: Oct. 22, 1985

[54] KNITTED FABRIC AND METHOD OF PRODUCING THE SAME

[75] Inventor: Karl Essig, Reutlingen, Fed. Rep. of Germany

[73] Assignee: H. Stoll GmbH & Co., Reutlingen, Fed. Rep. of Germany

[21] Appl. No.: 457,369

[22] Filed: Jan. 12, 1983

[30] Foreign Application Priority Data

Jan. 29, 1982 [DE] Fed. Rep. of Germany ..... 3203028

[51] Int. Cl.[4] ..... D04B 9/46

[52] U.S. Cl. ..... 66/172 R; 66/69

[58] Field of Search ..... 66/172 R, 173, 71, 69, 66/76, 73

[56] References Cited

U.S. PATENT DOCUMENTS

| | | | |
|---|---|---|---|
| 2,313,294 | 3/1943 | Garric | 66/172 R |
| 2,480,894 | 9/1949 | Alric | 66/172 R |
| 3,057,177 | 10/1962 | Alric | 66/172 R |

FOREIGN PATENT DOCUMENTS

| | | | |
|---|---|---|---|
| 715625 | 1/1942 | Fed. Rep. of Germany | 66/185 |

*Primary Examiner*—Ronald Feldbaum

*Attorney, Agent, or Firm*—Larson and Taylor

[57] ABSTRACT

This invention relates to a single- or double-Jersey knitted fabric which not only has a closed starting seam, but also a closed terminal seam (24, 24', 24'') which can follow a line of any shape, and a method of making the same on a machine having stitch-forming elements and having an arrangement for transferring and racking the formed stitches. The closed terminal seam (24) of the fabric may for example be formed by transferring the last terminal seam stitch (16), then racking the same, and finally transferring it to the next seam stitch and then knitting the two transferred stitches with a thread (25, 22) which may be either a separate thread or one used to form the remainder of the fabric. The linking stitch so formed (31) is then racked again and the next-succeeding selvedge stitch transferred thereto before being knitted with the thread into a further linking stitch.

6 Claims, 33 Drawing Figures

Fig. 5e
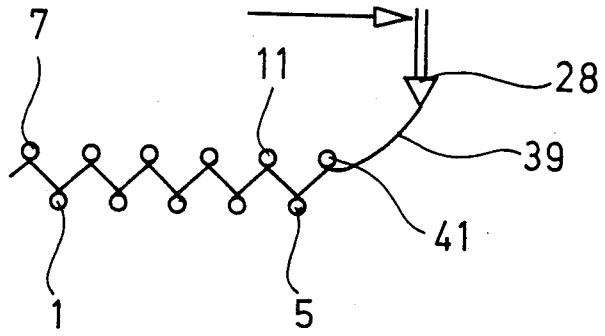
Fig. 5f
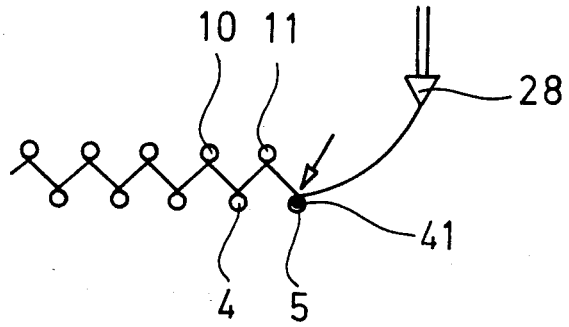
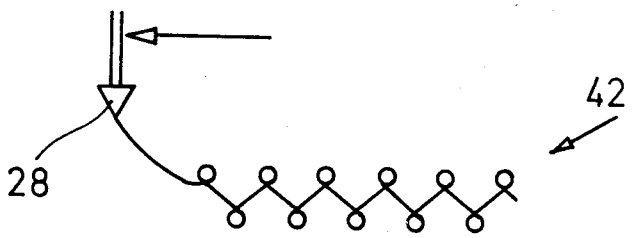
Fig. 5g
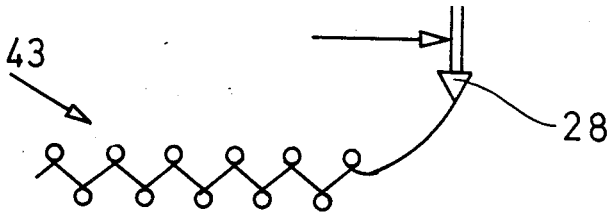
Fig. 5h

KNITTED FABRIC AND METHOD OF PRODUCING THE SAME

This invention relates to a single-Jersey or double-Jersey knitted fabric and a method of producing the same on a machine with stitch-forming elements and with an arrangement for transfer and racking of the formed stitches.

Knitted fabrics of current manufacture may be provided with a closed starting seam but will not have a similar type terminal seam. Thus the knitted fabric after being taken down from the knitting machine must be provided at the terminal edge with a linking thread or have applied thereto a knitted selvedge to safeguard against unravelling of the terminal stitch courses.

The object of the present invention is to produce a knitted fabric in which all the stitches at all edges are made safe against unravelling during the manufacture on the machine producing the actual fabric. According to the broadest aspect of the present invention there is provided a single-Jersey or double-Jersey knitted fabric having a closed fabric terminal seam which can follow any chosen line, that is to say may include a shaped fabric with a non-rectilinear terminal seam.

The fabric made in accordance with the invention can be made on a machine having stitch-forming elements and having an arrangement for transferring and racking the formed stitches, including, for example, a flat knitting machine of conventional construction. Depending on the type of knitted fabric or the desired or required form of the terminal seam of the fabric the latter can be made by various methods.

In the case of a single-Jersey fabric, following the present invention a method can be used to form a simple rectilinear closed terminal selvedge seam in which first the final terminal selvedge stitch is transferred and then racked, following this the next selvedge stitch is transferred, and the two transferred stitches are subsequently knitted with a thread and the linking stitch formed in this way is racked, the next selvedge stitch is transferred thereto and these two stitches are finally knitted with a thread. Subsequently the following selvedge stitches are treated in the same way one after the other.

In the case of a double-Jersey the closed terminal edge of the fabric can be produced by the method in which, to form a simple rectilinear closed fabric seam first the last marginal closure stitch on one support element is transferred to the corresponding marginal closure stitch on the other support element and then the two jointly suspended end seam stitches are knitted with a thread to form a first linking stitch, this first linking stitch is transferred to the next closed terminal stitch of one support element and then these two jointly suspended stitches are knitted with the thread to form a second linking stitch, this second linking stitch is then transferred to the next closed selvedge stitch of the other support element and finally the two jointly-hung stitches are knitted with the thread to form a third linking stitch, and then the succeeding marginal stitches are dealt with in the same way. If the terminal selvedge edge of the fabric is not rectilinear but curved or provided with an inclined terminal edge, in accordance with the invention to form the curved or inclined closed fabric seam, at least one new course of stitches is formed between the steps of transferring the marginal stitches described in the foregoing. The number of new stitch courses chosen depends on the required pitch of the terminal portion of the fabric. Small pitches of a required inclination can here be made.

Thus the invention has the great advantage that without using auxiliary devices, and for example on flat knitting machines which are now available in industry, knitted fabrics with a closed terminal seam extending in any required direction can be made. A further advantage is provided by the fact that the closed fabric terminal seam can be made with the same elasticity as the adjoining knitted fabric, and thus no inelastic edge seam need occur. This can be achieved in accordance with the invention by the fact that the knitting of the transferred stitches with one thread can take place with stitch lengths which are longer and differ from those of the stitches in the fabric. This prevents an undesirable contraction of the edge of the fabric. In this invention, in the case of knitted fabrics the closed fabric terminal seam can be achieved without varying the draw property of the knitted fibre in that a multiple knitting off of the linking stitches is carried out and a multi-course closure seam made. In this connection in accordance with a feature of the present invention a first plurality of stitches located at the end of a terminal stitch course can be knitted with a thread to form first linking stitches which are then knitted with the thread to form further and second linking stitches, and these are then transferred and racked through at least one stitch width and finally transferred back, this procedure being repeated until all the edge stitches have been dealt with.

The knitting up of the terminal seam stitches can be carried out with a separate fabric terminal thread which varies in type and/or thickness and/or colour. It can however be carried out also with the same thread used for forming the final stitch course.

The invention will now be described further, by way of example, with reference to the accompanying drawings in which.

Figure 4D:
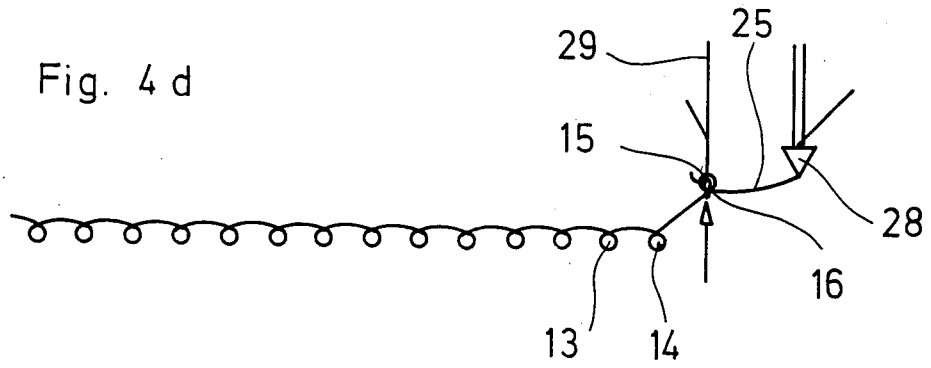
Figure 4C:
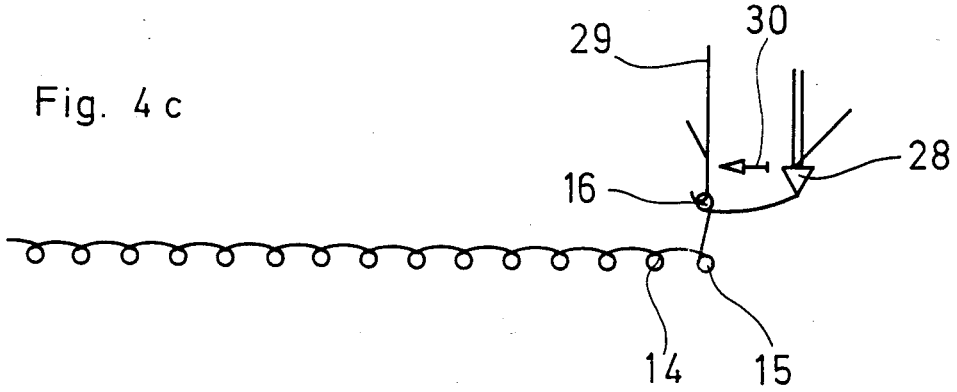
Figure 4B:
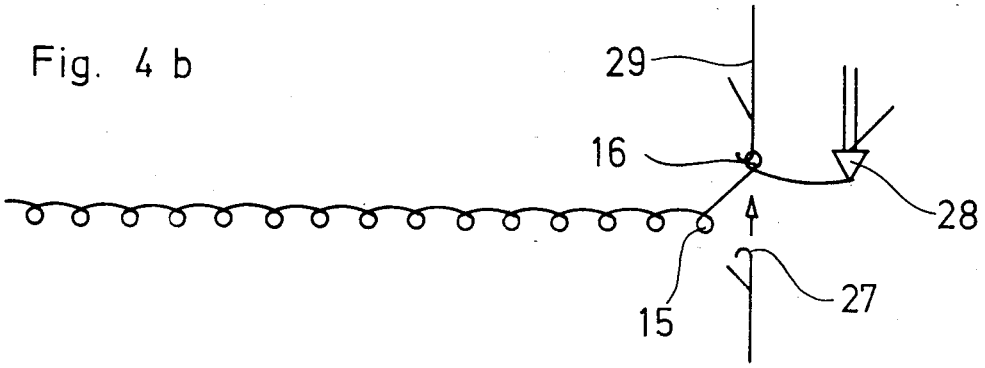
Figure 4A:
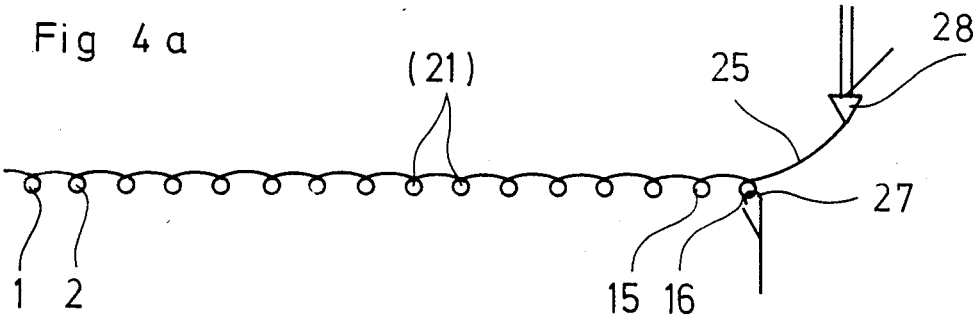
Figure 4H:
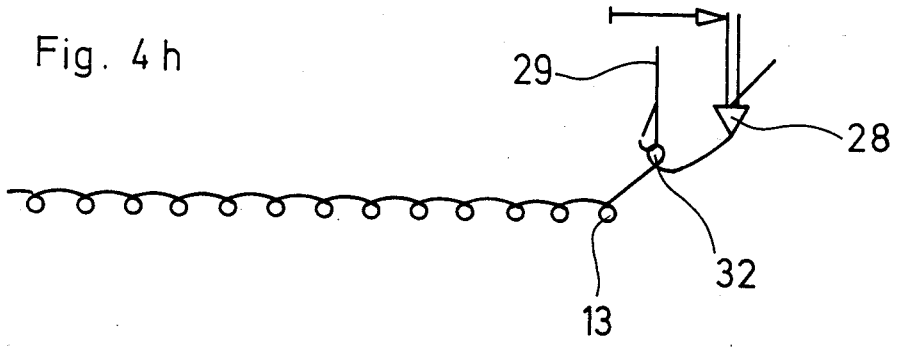
Figure 4G:
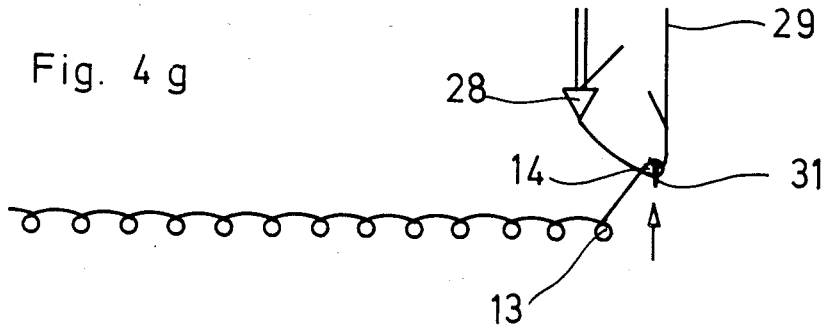
Figure 4F:
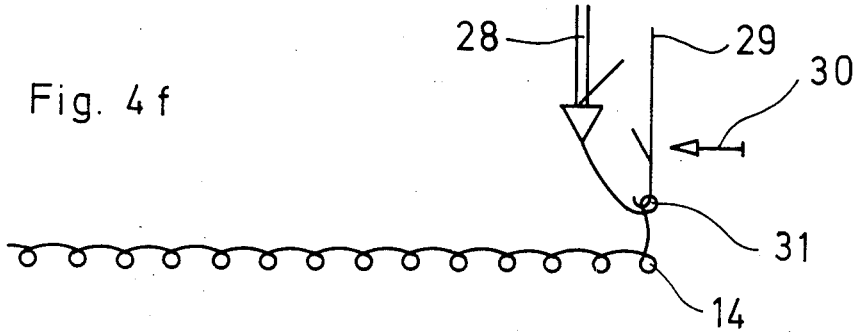
Figure 4E:
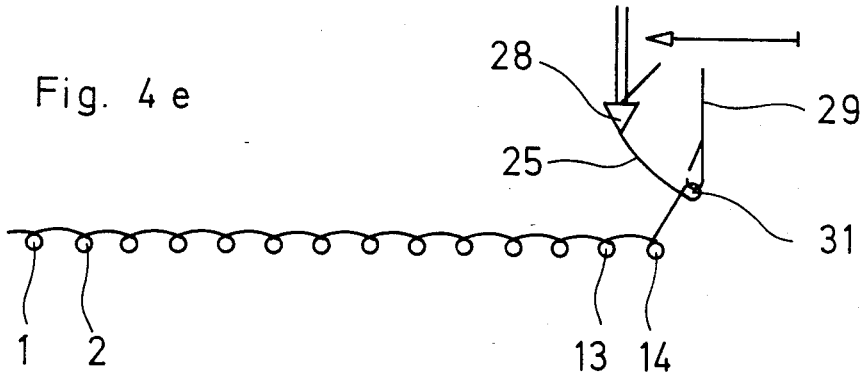
Figure 4K:
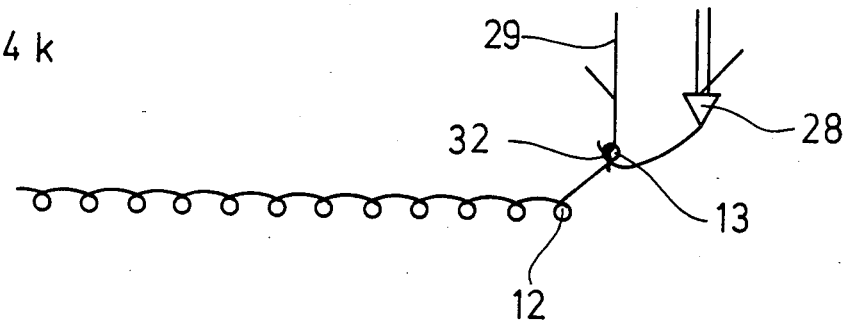
Figure 4I:
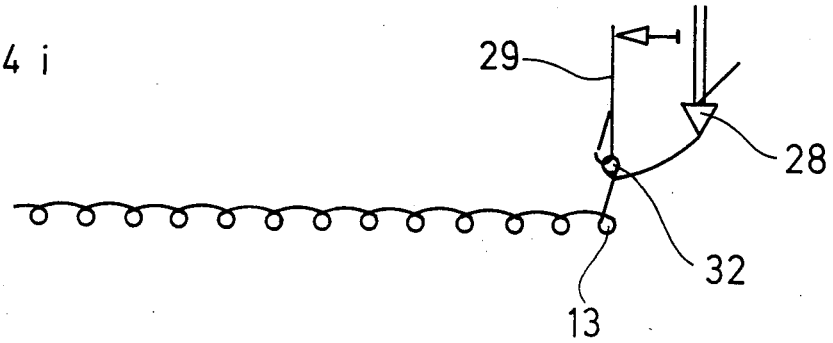
Figure 4I:
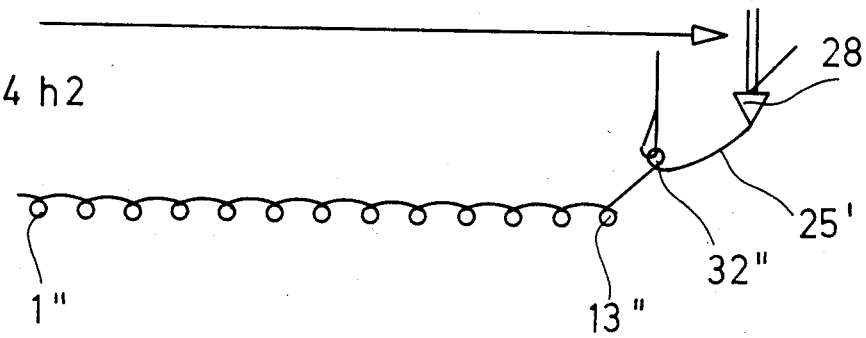
Figure 4I:
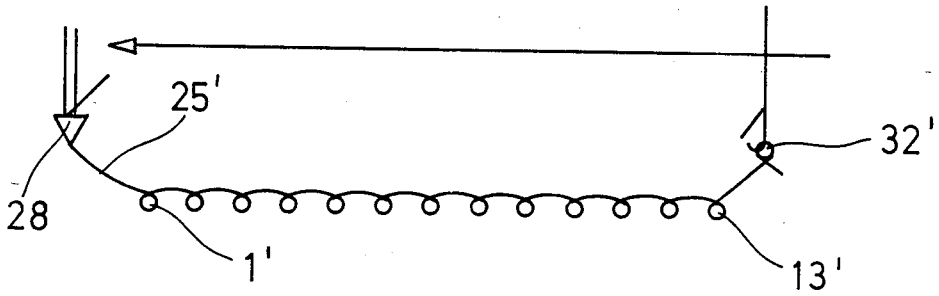
Figure 4O:
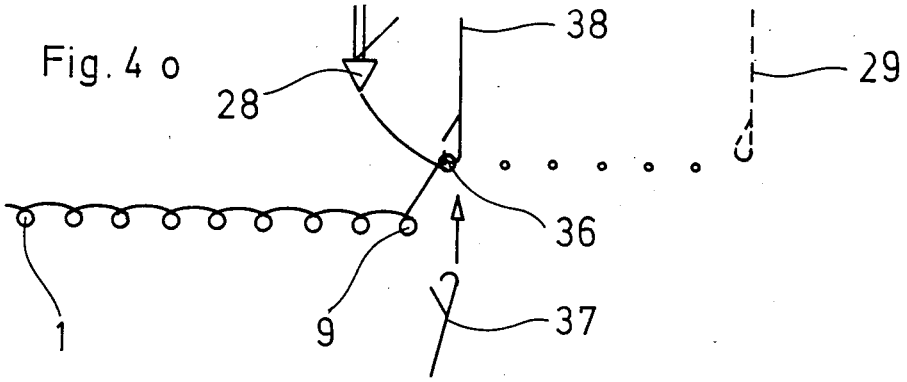
Figure 4N:
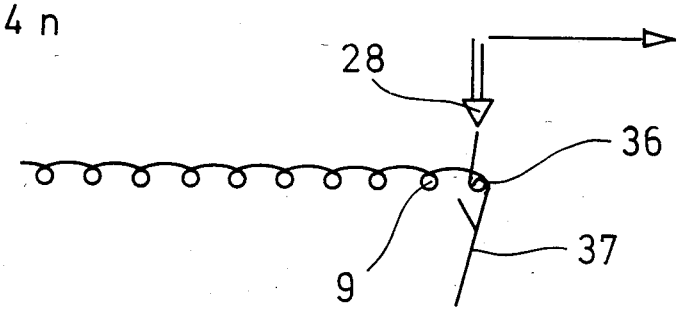
Figure 4M:
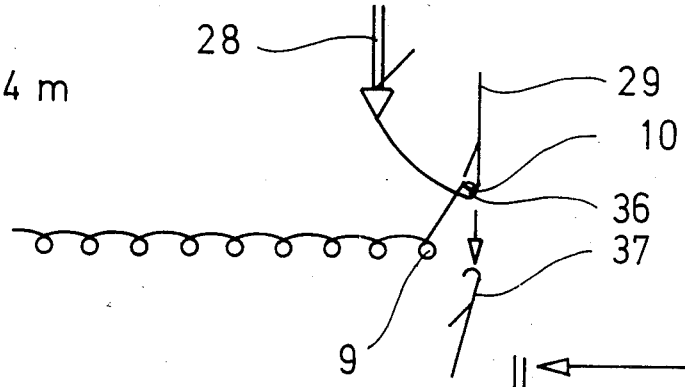
Figure 4L:
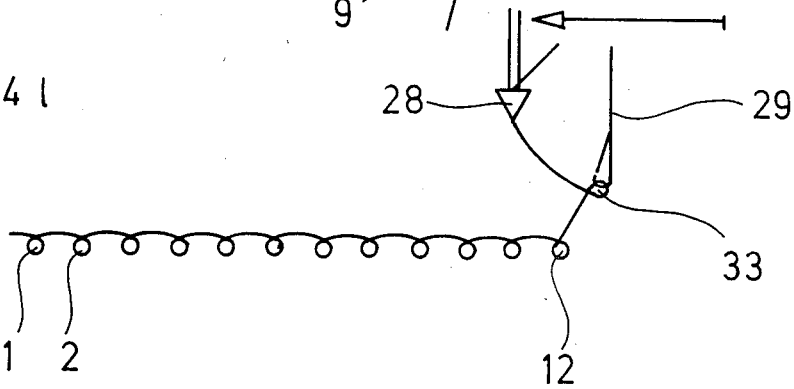

FIGS. 4*a*–4*o* are diagrammatic representations of the individual steps in the formation of a rectilinear closed terminal seam of a single-Jersey fabric knitted on a two-bed flat knitting machine;

FIGS. 4*$h_1$*–4*$h_2$* are diagrammatic illustrations of supplementary method steps inserted between the steps shown in FIGS. 4*h* and 4*i* to form a non-rectilinear closed terminal seam on a fabric FIGS. 5*a*–5*h* are diagrammatic illustrations of the successive steps in the method of forming a single-Jersey rectilinear closed terminal seam on a double-Jersey knit fabric made on a two-bed flat knitting machine;

FIGS. 6*a*–6*f* are diagrammatic illustrations of the steps in the method of producing a multi-course closed terminal seam on a single-Jersey knitted fabric made on a flat knitting machine having a stitch transfer and racking arrangement.

Figure 1:
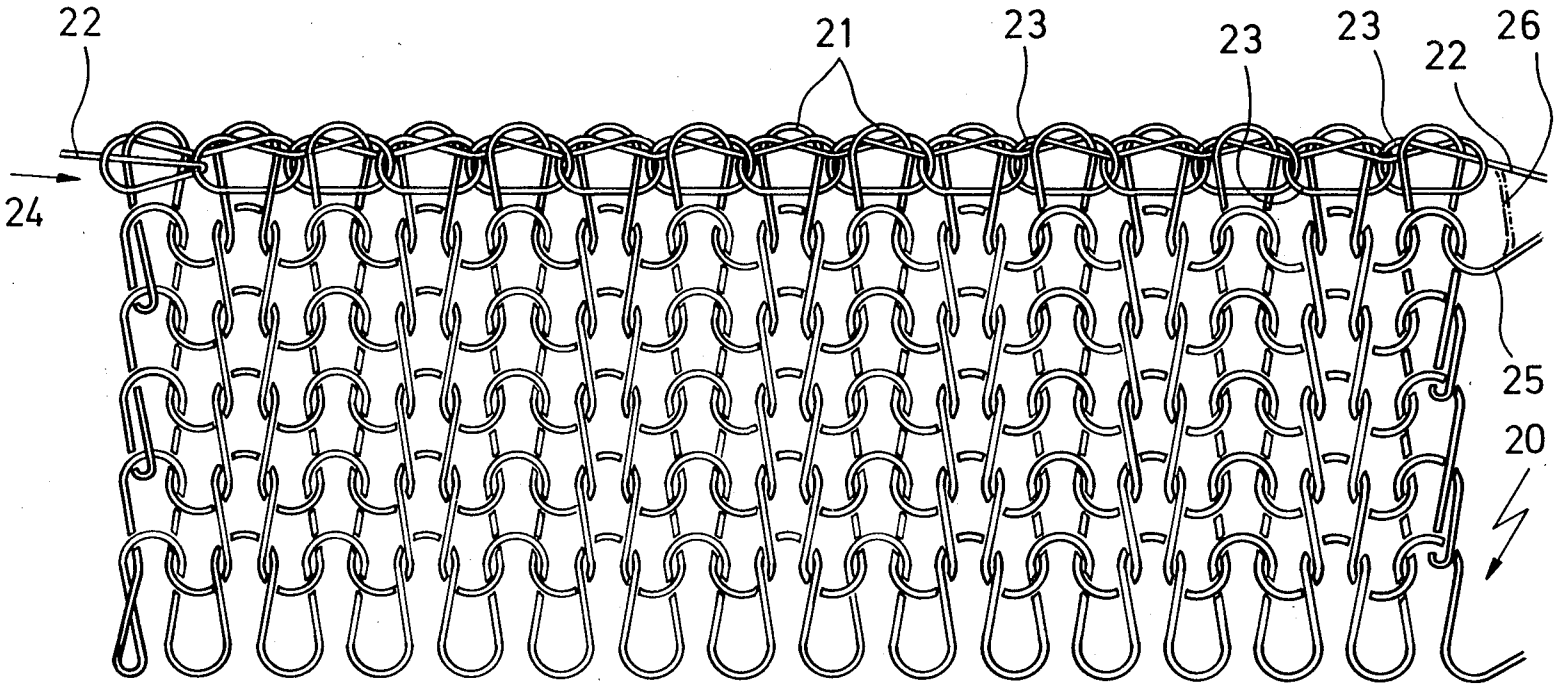
FIG. 1 is a partial view of a double-Jersey knitted fabric with a simple rectilinear, closed terminal seam.

FIG. 1 of the drawings shows a double-Jersey knitted fabric 20 with a regular succession of right handed and left handed stitches. The upper closed end seam 21 in FIG. 1 is knitted with a separate thread 22 which, in forming linking stitches with ends designated 23, produces a rectilinear closed terminal seam 24 in the fabric. Instead of using a separate thread 22 the thread used for forming the knitted fabric 20 and extending to the right hand upper corner of FIG. 1 can be used to made the fabric terminal seam 24, as indicated by a dotted connecting bridge 26.

Figure 2:
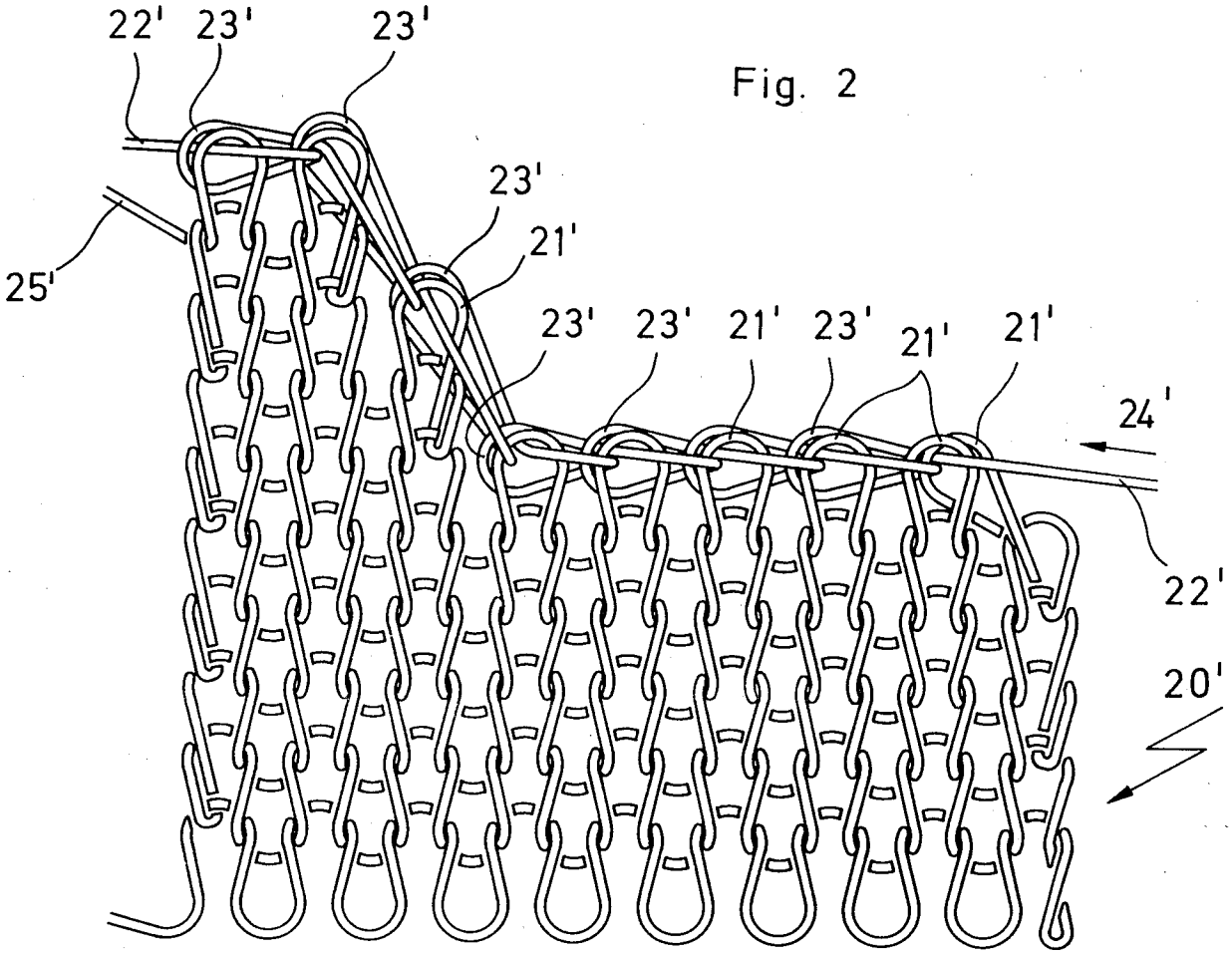
FIG. 2 is a partial plan of a single-Jersey knitted fabric with a simple non-rectilinear closed terminal seam.

Whilst the fabric terminal seam 24 extends rectilinearly in FIG. 1, FIG. 2 shows a non-rectilinear terminal area in a single-Jersey knit 20' which is made up of right-hand stitches. Here the terminal selvedge seam 21' of the narrowed fabric 20' is incorporated in a simple terminal seam 24' made by a thread 22' and linking stitches with heads 23'. Here again the fabric terminal seam 24 need not be made from a separate thread 22' but can instead be formed by the thread 25' used to make the remainder of the knitted fabric 20'.

Figure 3:
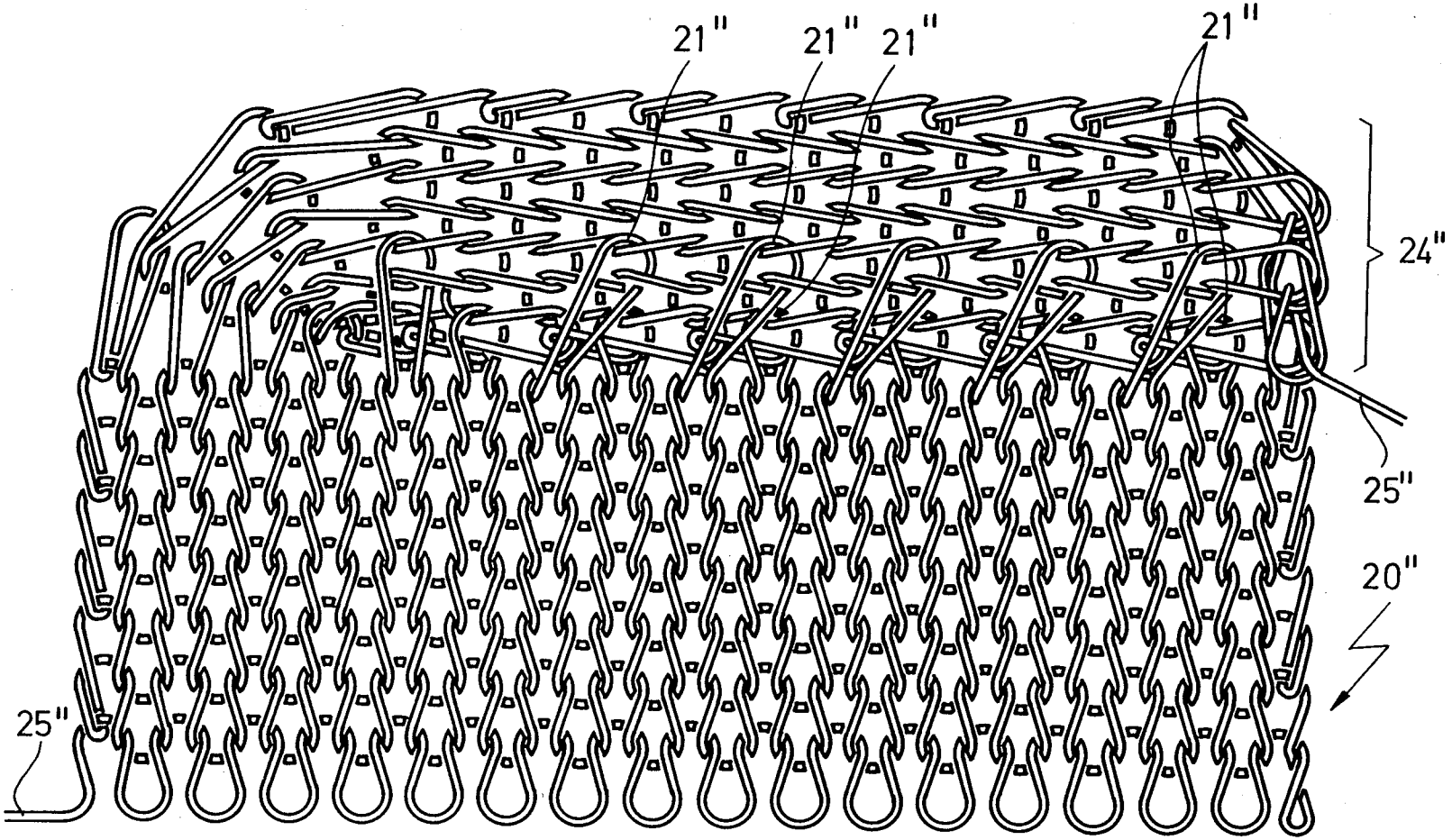
FIG. 3 is a partial plan of a single-Jersey knitted fabric with a multi-course closed terminal seam.

FIG. 3 shows a single-Jersey fabric 20'' having a multi-course terminal seam 24'' which, in the case illustrated, is formed from the thread 25' from which the remainder of the knitted fabric 20'' is made. The formation of such a multi-course terminal seam 24'' is explained below more particularly in conjunction with FIG. 6.

FIG. 3 shows a few of the edge stitches 21'' bound up in the fabric terminal seam 24''.

FIGS. 4*a*–4*o* illustrate the individual phases of the method in which a single fabric terminal seam 24 or 24' in accordance with FIG. 1 or FIG. 2, is made on a flat knitting machine comprising two needle beds, transfer mechanism and a racking mechanism, without using auxiliary additional means.

FIG. 4*a* shows the selvedge row of stitches of the finished single jersey fabric this comprising sixteen stitches of the final stitch course 21. These sixteen stitches are designated by the numbers 1 to 16 in FIG. 4*a* and are located in the needle hooks 27 of the front needle bed of the flat knitting machine. The thread guide elements 28 which feed the thread 25 to form the stitches 1 to 16 of the marginal stitch course 21 are disposed at the righthand edge of the fabric.

At the beginning of the formation of the closed fabric end seam in accordance with FIG. 4*b* the last stitch course 16 is transferred from the needles 27 of the front needle bed to the associated needles 29 of the rear and offset needle bed. It should be assumed that the rear needle bed is brought into a staggered position from which it can be shifted to the left through six needle divisions in all.

In accordance with FIG. 4*c* by racking the rear needle bed through a step of one needle division the needles 29 provided with the transferred selvedge stitches 16 are brought to the height of the rear stitches 15 which are transferred in accordance with FIG. 4*d* to the needles 29. In accordance with FIG. 4*e* the selvedge stitches 15 and 16 suspended in common in the needles 29 are taken off by the threads 25 introduced by the thread guide elements 28, that is to say by the threads from which the marginal stitches 1 to 16 have been formed, and a first linking stitch 31 also formed.

As shown in FIG. 4*f* the rear needle bed, and with it the needles 29, are racked through a further needle division leftwards in the direction of arrow 30 so that they lie opposite the marginal stitches 14. In accordance with FIG. 4*g* the marginal stitches 14 on the needles 29 are transferred to the linking stitches 31 and 14 disposed on the needles 29 are then knitted off to the right in accordance with FIG. 4*h* during a rearward movement of the thread guide elements 28*e*, a second linking stitch 32 then being produced.

The transfer and racking procedure described above is now repeated. In accordance with FIG. 4*i* the rear needle bed with its needles 29 and the linking stitches 32 held thereby are racked leftwards through a further needle division, and then, see FIG. 4*k*, the next marginal stitch 13 is transferred and subsequently in accordance with FIG. 4*l*, by a sifting of the thread guide elements 28 to the left, the two stitches 32 and 13 in the needle 29 are knitted off and a further linking stitch 33 is formed. This procedure is repeated until the racking span of six needle divisions of the rear needle bed has been used. To return the rear needle bed to its starting position by movement to the right the last-made linking stitch 36 (see FIG. 4*m*) is transferred back from the needles 29 to the needle 37 of the front needle bed associated with the previously transferred edge stitch 10. Then in accordance with FIG. 4*n* the rear needle bed is moved back six needle divisions to the right. Following this and as shown in FIG. 4*o* the linking stitch 36 last formed is transferred at the rear needle bed to the needle 38 now located there, and the transfer and knitting off procedure previously described is then repeated until the last marginal stitch 1 is bound up into the terminal seam 23' (24).

Insofar as the fabric terminal seam 24' of FIG. 2 is of rectilinear form, that is to say must be provided on a shaped knitted fabric, the narrowing of the knitted fabric is continued at the marginal area into the terminal seam formation, that is to say the formation of the terminal seam is first interrupted at the narrowing area. Thus the procedure for forming the terminal fabric seam illustrated in FIGS. 4*a*–4*o* is, for example, interrupted between those steps of the process illustrated in FIGS. 4*h* and 4*i* and a normal new stitch formation of two courses of stitch is carried out over the then prevailing full knitting width, i.e. thirteen stitches at this point using the thread guides 28 and their threads 25' as in FIGS. $4h_1$ and $4h_2$, namely the stitches designated 1' to 13' and 1'' to 13'' in these figures. After this knitting phase the stitches 1'' to 13'' constitute the new marginal stitches which are knitted off in continuation of the terminal seam formation indicated in FIGS. 4*i* to 4*o*. It is apparent that the fabric terminal seam formation can be interrupted at other places to cater for the production of further normal stitch course of the fabric depending on the required shaping of the terminal edge of this fabric.

Figure 5A:
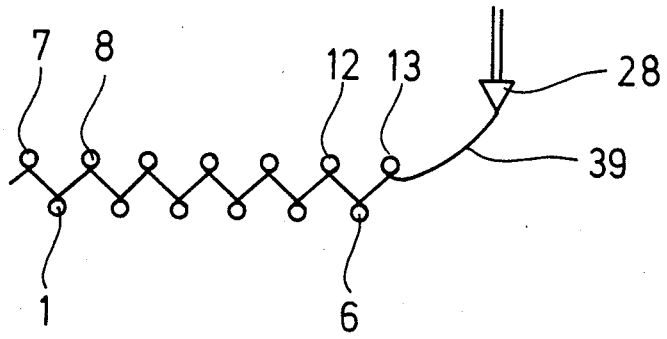
Figure 5B:
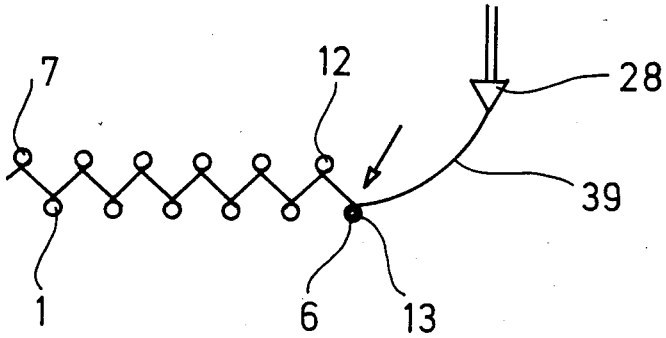
Figure 5C:
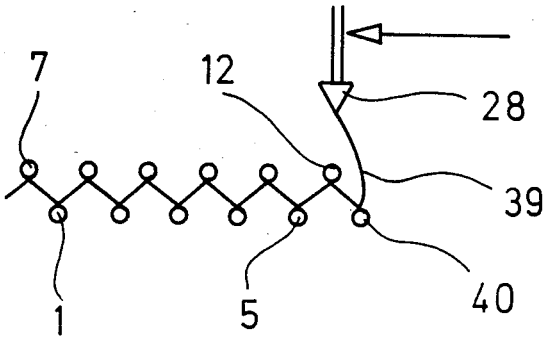
Figure 5D:
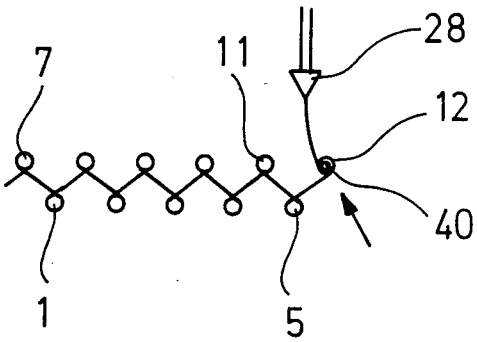

FIGS. 5*a*–5*h* show the steps in the process during the formation of a closed terminal seam in the case of a double-Jersey knit fabric. FIG. 5*a* shows stitches 1 to 6 disposed on the needles of the front needle bed on a flat knitting machine, and stitches 7 to 13 on the needles of the rear needle bed of the machine. The thread guides 28 for threads 39 are located at the righthand edge of the double-Jersey knit. In accordance with FIG. 5*b* the stitch 13 is transferred from the rear needle bed to the stitch 6 in the front needle bed, and then in accordance with FIG. 5*c* the two stitches 6 and 13 are knitted off with the thread 39 to the first linking stitch 40 during a movement of the thread guide element 28 to the left. The linking stitch 40 is then transferred, see FIG. 5*d*, to the stitch 12 in the rear needle bed, and during a return movement of the thread guide element 28 to the right the two interlinked stitches 40 and 12 are knitted off through the thread 39 to a second linking stitch 41 in accordance with FIG. 5*e*. The whole procedure is then continually repeated until all the marginal stitches 1 to 13 are knitted off into link stitches. Thus FIG. 5*f* corresponds to FIG. 5*b*. The linking stitch 41 is transferred to the stitch 5 in the front needle bed and a knitting-off phase in accordance with FIG. 5*c* is performed to make the next linking stitch.

If an inclined or curved marginal section is to be provided with a closed fabric seam, analogously to the method steps of FIGS. $4h_1$ and $4h_2$ whole courses of stitches, such as those depicted 42 and 43 in FIGS. 5*g* and 5*h* will be knitted in before the formation of the closed terminal seam of the fabric is continued with the method steps shown in FIGS. 5*a*–5*e*.

Figure 6A:
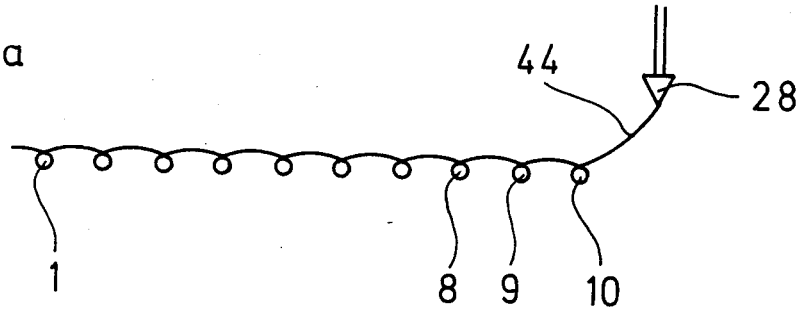
Figure 6B:
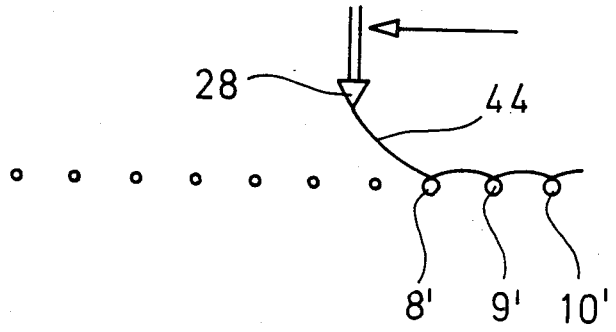
Figure 6C:
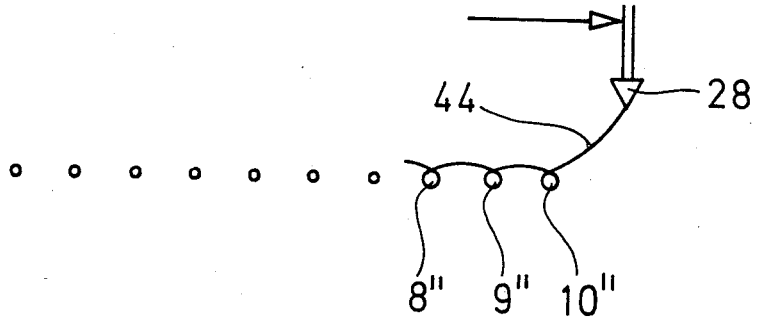
Figure 6D:
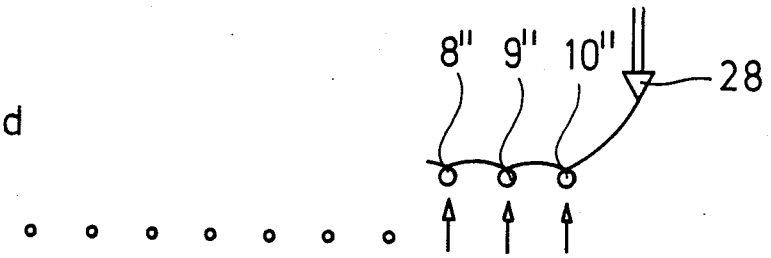
Figure 6E:
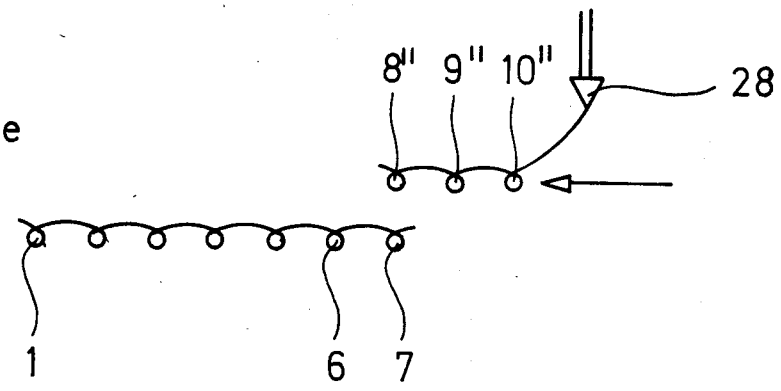
Figure 6F:
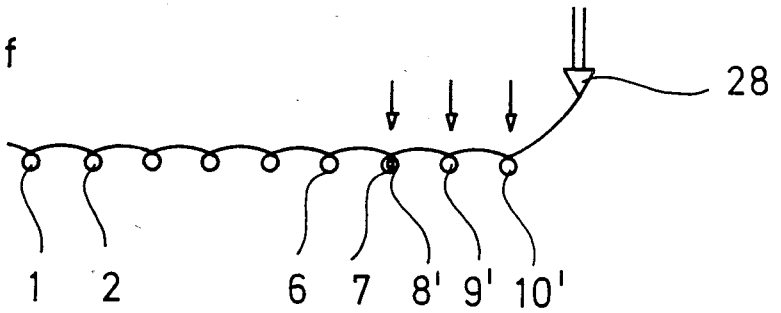

FIGS. 6*a*–6*f* explain the steps of the process in which a multi-course fabric seam can be formed as illustrated in FIG. 3. FIG. 6*a* shows stiches 1 to 10 of a single-Jersey knitted fabric in the front needle bed. The thread guide 28 again is located at the righthand fabric edge. With the threads 44 introduced by the guides 28 the three outer marginal stitches 8, 9 and 10 are for example knitted off to form three linking stitches 8', 9' and 10' as shown in FIG. 6*b*.

Then during a return movement of the thread guide 28 to the right the linking stitches 8', 9', 10' are knitted off with the thread 44 so to form the linking stitches 8'', 9'' and 10''. These linking stitches 8'', 9'', 10'' are then, see FIG. 6*d*, simultaneously transferred to the rear needle bed and thereafter, see FIG. 6*e*, the rear needle bed is racked through a needle division—as in the embodiment illustrated—or it could be through a plurality of needle divisions. After the racking of the needle bed—here through one needle division—the linking stitches 8'', 9'', 10'' are transferred back to the front needle bed, and the fabric terminal edge is linked around one needle. The whole procedure of FIGS. 6*a* to 6*f* is now repeated until the complete selvedge edge of the fabric has been knitted.

I claim:

1. A method for producing a knitted single-jersey fabric with a closed terminal seam on a knitting machine comprising two needle beds, stitch forming needles, a racking device, means for transferring the formed stitches from the needle bed where they are formed to the other needle bed, and a needle-selecting device, said method comprising:

(i) forming the selvedge stitches of the knitted fabric on one of the two needle beds;

(ii) transferring the selvedge stitch of the last wale from the needles of the one needle bed which are holding that wale onto the corresponding needle of the other needle bed for racking;

(iii) racking the other needle bed through a needle division step and providing therewith movement of the transferred last selvedge stitch to the level of the adjacent wale with its selvedge stitch;

(iv) transferring the selvedge stitch of the adjacent wale to the needle of the other needle bed;

(v) knitting off both transferred stitches with a thread so as to form a first linking stitch;

(vi) racking the other needle bed again through a needle division step at the level of the next wale with its selvedge stitch;

(vii) transferring the said selvedge stitch of said next wale to the needle of the other needle bed to the linking stitch found there;

(viii) knitting off said transferred stitch of said next wale and said linking stitch to form a second linking stitch; and (ix) repeating steps (vi) to (viii) to form a desired number of wales.

2. A method as claimed in claim 1 for formation of a curved closed terminal seam, wherein at least one additional row of stitches is formed on the knitted fabric, between the method steps of bringing together the selvedge stitches and linking stitches, the selvedge stitch then being bringing together with a said linking stitch formed beforehand in continuing the method.

3. A method as claimed in claim 1, wherein during the knitting off of the needles with the said thread into said linking stitches, the linking stitches are formed with greater stitch length than that of the selvedge stitches.

4. A method as claimed in claim 1, wherein the linking stitches are formed with the same threads that the selvedge stitches had been formed with beforehand.

5. A method as claimed in claim 1, wherein the linking stitches are formed with a thread that differs from the threads forming the knitted fabric.

6. A method as claimed in claim 1 for producing said closed terminal seam in a single-jersey fabric produced on one of said two needle beds of said knitting machine, wherein all said linking stitches are formed on the other of said two needle beds which is not used for producing the basic fabric.

* * * * *